United States Patent [19]

Eisermann

[11] Patent Number: 5,074,135

[45] Date of Patent: Dec. 24, 1991

[54] SYSTEM FOR THE USE OF LOCKERS OR THE LIKE

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 234,855

[22] Filed: Aug. 22, 1988

[30] Foreign Application Priority Data

Aug. 22, 1987 [DE] Fed. Rep. of Germany ..... 3728073
Dec. 17, 1987 [DE] Fed. Rep. of Germany ..... 3742826

[51] Int. Cl.[5] ..... E05B 25/00; E05B 47/00

[52] U.S. Cl. ..... 70/276; 70/383; 70/384; 340/825.31

[58] Field of Search ..... 70/276, 413, 382–385; 340/825.31

[56] References Cited

U.S. PATENT DOCUMENTS

Re. 29,846 11/1978 Genest et al. ..... 235/449 X
4,312,198 1/1982 Sedley ..... 70/395 X
4,519,228 5/1985 Sornes ..... 70/276
4,676,083 6/1987 Sedley et al. ..... 70/276
4,727,975 3/1988 Eisermann ..... 70/276 X

FOREIGN PATENT DOCUMENTS 0024242 2/1983 European Pat. Off. .
3421667 12/1985 Fed. Rep. of Germany .
2177154 1/1987 United Kingdom .

*Primary Examiner*—Lloyd A. Gall
*Attorney, Agent, or Firm*—Martin A. Farber

[57] ABSTRACT

The invention refers to a system for the use of locks of hotel room doors, lockers of bathhouses or similar facilities, having a central delivery station located in the region of an entrance station of the hotel, bathhouse or the like for the issuance of locking elements (keys) each of which fits a given lock of the different doors, lockers or the like, and a locking-element return device which is located in the region of an exit station and scans the locking element and evaluates it, for instance, with respect to a change for use, said return device being connected for data to the delivery station, and in order to obtain optimum handling, it proposes that the locking element bear an additional code (for instance a bar code) in order to trace its path of use.

20 Claims, 11 Drawing Sheets

SYSTEM FOR THE USE OF LOCKERS OR THE LIKE

FIELD AND BACKGROUND OF THE INVENTION

The present invention relates to a system for the use of hotel room doors, lockers of bathhouses or similar facilities, having a central delivery station located in the region of an entrance station of the hotel, bathhouse or the like for the issuance of locking elements (keys), each of which fits a given lock of the different doors, lockers or the like, and a locking-element return device which is located in the region of an exit station and scans the locking element and evaluates it, for instance, with respect to a change for use, the return device being connected for data to the delivery station.

In the known systems of this type (Federal Republic of Germany OS 34 21 667) which are designed for use in bathhouses, a strip-shaped locking element is provided with a magnetic coding in the area of the delivery station. This code agrees with a corresponding magnetic coding of a given lock. After the guest has received such a coded locking element from the delivery station upon payment he goes to the corresponding locker in the bathhouse and can actuate it in view of the concordant magnetic coding. Upon leaving the bathhouse he returns the locking element to the return device. By the data connection between the return device and the delivery station it can be noted, for instance, whether the guest has exceeded his time. If not, he can leave the bathhouse through the exit barrier. If he has exceeded it he will have to make an additional payment. The advantage of this solution is that the locking elements are not coded until they are issued, and that this code agrees with the code of a given lock. In order to take into account the problem that the code of several locking elements issued one after the other is different but, on the other hand, no wires connecting the delivery station to each lock are required in order to transmit the corresponding different code there, this solution of the prior art proposes that the magnetic coding of the locking element be effected in the delivery station in accordance with an update program which is identical with a program stored in the corresponding lock. This solution is relatively expensive electronically. It also cannot cover absolutely all possibilities of error; thus, for example, difficulties can arise if a guest fails to go to his locker with the correspondingly coded locking element which he has received at the delivery station of the entrance barrier and, for some unexpected reason, immediately leaves the bathhouse again. In such case the lock itself has not received the update command which is coded on the preceding unused locking element.

SUMMARY OF THE INVENTION

The object of the present invention is so to develop a system of this type that, while being, in particular, of simple electronic construction, it incorporates greater safeguards against errors and does so without impairing the security upon correct use.

This is achieved by a delivery station having a store of locking-element cards with different identifier, and a magnetization device which polarizes regions of the locking-element card to conform magnet-pin combination of a locker lock. Furthermore the magnetization device is coupled with a memory which retains the magnetization combination corresponding to the corresponding identifier. Included within the system is a return device having an identifier scanning device which initiates an erasing device of the delivery station to free the corresponding magnetization combination for a new issue and assignment to a new identifier.

Due to this development of the system, the result is obtained that, despite considerably less electronic expense, which is of advantage particularly in hotels and bathhouses, the ease of operation and the reliability of operation are greater. Nevertheless, it is not necessary to connect the delivery station to the individual locks by wires. The locks can rather even be substantially based on locks which can be used also elsewhere, for instance in the apparatus disclosed in European Patent 24,242. The locking-element card has on one of its sides an area of magnetization and on the other side an identifier. This is preferably developed in the form of a bar code. Such card configurations are readily available today. The magnetization combination which is additionally present serves to actuate the magnet tumbler pins of the locks which are arranged in corresponding local combinations. The characteristic feature of the invention resides now in the fact that in each case the delivery station assigns a very specific magnetization combination to a given locking-element card identified by the bar-code identifier. During use of the card, the further course of the card is not followed up by means of the magnetization combination but via the bar code identifier, which is much easier to follow up.

The delivery station, for instance a PC with printer for the locking-element card, records the bar code identifier in relation to the polarized area of the locking-element card which is effected in each case within the delivery station. This allocation is retained in the memory of the delivery station. Via the identifier scanning device, the return device then in its turn identifies only the bar code identifier and gives a report to the erasing device of the delivery station so that it is known there that the user of the room or locker corresponding to this magnetization combination has already left the bathhouse or hotel. This same magnetization combination can be then assigned to a new locking-element card which is again provided with the bar-code identifier and issued.

The locking-element card itself need not even be returned immediately to the delivery station in order to make the same lock (room door or the like) available as fast as possible to the next guest. Thus the number of uses of the lock per unit of time is considerably increased. On the other hand, at the end of a given period of time, for instance one bathhouse day, the complete return of all locking-element cards collected in the return device to the locking-element card storage of the delivery station can take place. The same locking-element cards with the same bar code identifiers can therefore be used again. Also no difficulties can arise if someone leaves the hotel, bathhouse or the like without having used his key at all. Furthermore, there can be no danger of breaking in as in the case of other systems by a guest obtaining two locking-element cards in order to use one for himself and to wait with the other until another guest has occupied a given room, locker or the like. If a locking-element card is lost, the corresponding lock is for the time being no longer available. Master lock functions can also be obtained by corresponding deliveries.

In accordance with one advantageous development of the invention, an indication of the locking elements which have not been returned can be given off at recurrent intervals or made subject to call. If then, in accordance with a further feature of the invention, the magnetization combination of the locks are changed, for instance by an operating tool in accordance with the disclosure of European Patent 24,242, and the delivery station displays a command as to what change is to be effected in order to avoid any magnetization combination which corresponds to a locking-element card which has not yet been returned, then the supervisory person of the hotel, bathhouse or the like can, further exclude any danger of misuse by changing the magnetization combination. Magnetization combinations of locking-element cards which have not been returned are eliminated after a reasonable period of time. On the other hand, should it happen that, a key having been lost, the locker has to be opened, the delivery station can be caused by a specially authorized person to again issue the same locking-element card which belongs to the corresponding lock.

In this connection then, on the other hand, inquiry can be made via the bar code identifier as to whether and when an allegedly lost locking-element card was previously issued and whether it was not recorded by the return device. Compliance with specified periods of use is verified in this connection by means of the bar code identifier. Via this bar code identifier there can then be billed, for instance, at the hotel reception desk or at the exit barrier of a bathhouse, additional services which have been utilized, such as, for instance, use of the solarium, purchase of beverages, etc.

The object of the invention is shown by way of summary of the invention, on the accompanying overall sketch (FIG. 18) in one embodiment referring to a bathhouse.

The main entrance to the bathhouse or the like is designated 100. From it the visitor enters an anteroom 200. In order to be able to use the bathhouse he must pass through the entrance barrier, which is developed in the form of a turnstile 300. The turnstile is mounted on a vertical shaft 400 and has several turnstile arms 500 arranged one above the other, thus preventing unauthorized passage. The system can also be used in a hotel, in which case entrance station and exit station are located near the so-called reception desk.

A delivery station 600 for cardshaped locking elements is associated with the entrance barrier 300. The delivery station has an operating panel 700. The money is introduced there. In the delivery station 600 a plurality of locking-element cards 800 are stored, preferably in a stack. They have different bar codings. These codings can be read by a suitable device at the exit station turnstile 1600. After the insertion of the money, a given locking-element card 800 is removed from the stack, its code is noted, and it is passed below a magnetization device which magnetizes an area of the locking-element card 800, represented by the magnet part surfaces MP of the locking-element card 800' which lies below the magnetization device. An electronic memory of the delivery station 600 stores what given magnetization combination (local association, including lateral polarization of the fields MP on the card 800') belongs to the corresponding bar code identifier of the locking-element card. The card is then issued. The user takes it along on the path indicated by the arrow and goes to the corresponding locker of the schematically shown row of lockers S.

The proper locker is found by the bathhouse guest by the corresponding imprint of the numbers on the locking-element card 800, said number having been imprinted upon or after the magnetization. With the use of his card he actuates the lock 1100. He cannot actuate other locks because of the nonconcordance of the magnetization combination MP. After he has completed his use of the bathhouse he goes to the exit barrier. There the turnstile 1600 is present. In order to cause the turnstile 1600 to open he introduces his locking-element card into a panel 1800 of a return device 1700. It contains an identifier scanning device. The device scans the bar code identifier of the locking-element card 800. This, on the one hand, in order to check, via the data connection to the delivery station 600, whether the specified time of use of the bathhouse has been complied with or exceeded. In the event of compliance and no charge for additional services, the turnstile is released for opening. The returned card is collected. At the same time, the reading by the identifier scanning device initiates an erase command at the delivery station 600 so that the corresponding magnetization combination is again recorded as freed and again available, namely available for assignment to a different locking-element card 800 having a different bar code identifier.

The following figures show, by way of example, various solutions for a lock which automatically adjusts itself to a new magnetic coding when it is operated with a specific command key. This affords the possibility of dispensing with the indicator device. A resetting of the lock by a tool or the like need not and cannot be effected any longer. If, for instance, a locking-element card is not returned in the evening then a corresponding command key will be issued the next morning. It effects the resetting of the lock to the new magnetic coding, which is then retained until such a case of disturbance again arises.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
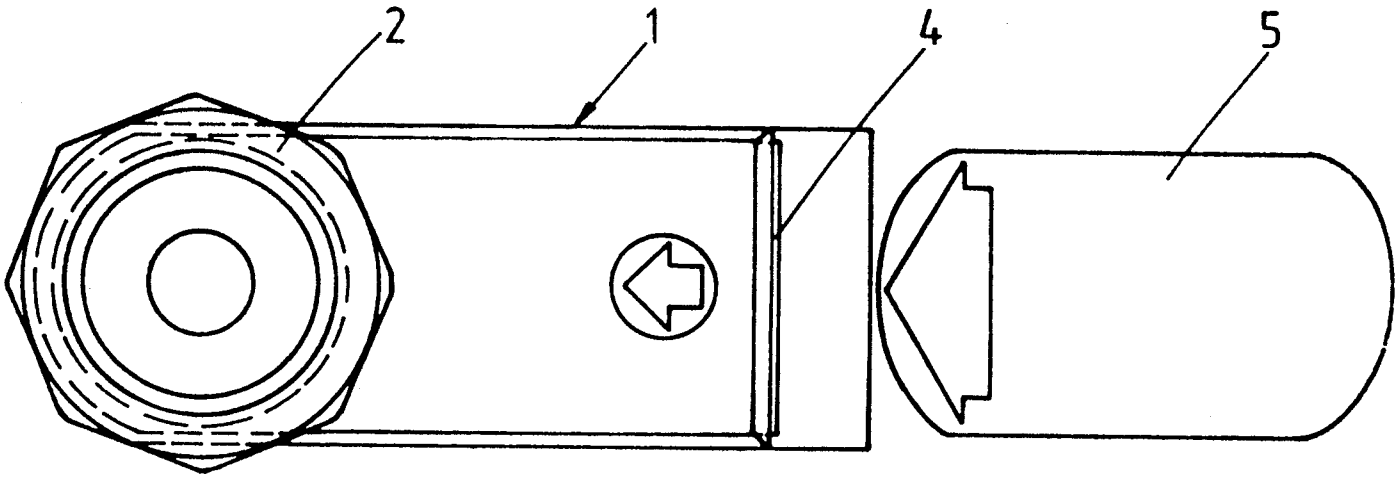
FIG. 1 shows a lock adapted to be fastened to a locker door, together with a corresponding card-shaped key.
Figure 2:
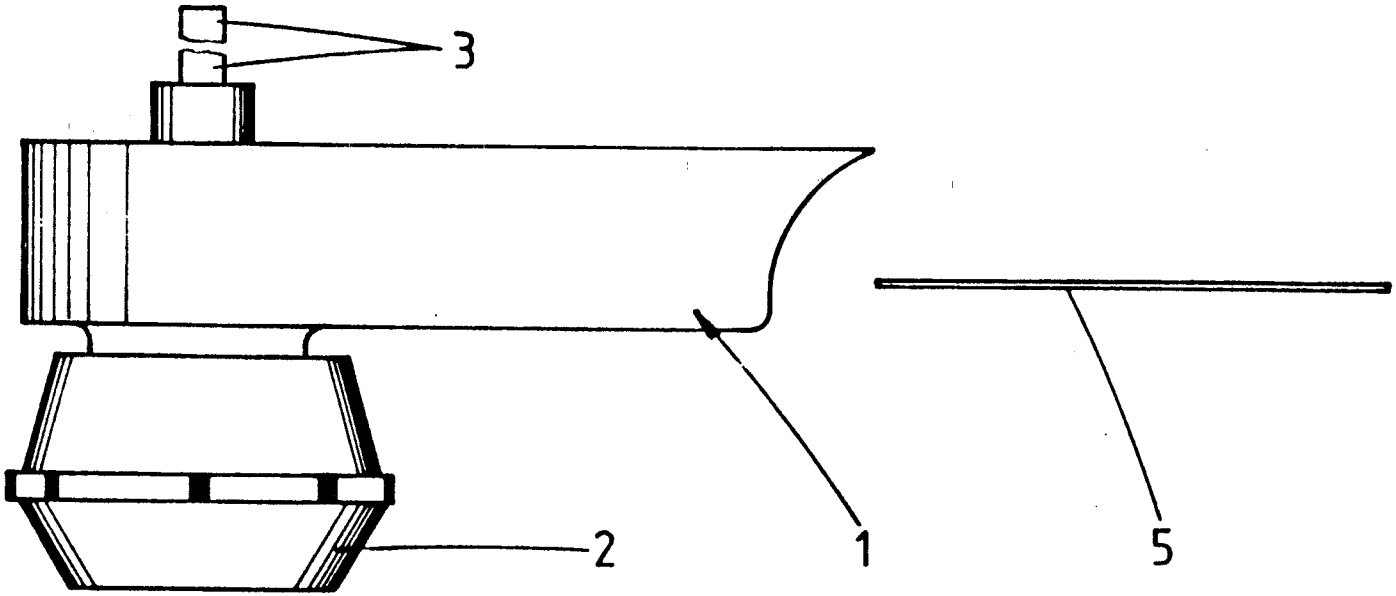
FIG. 2 is a top view of FIG. 1.
Figure 3:
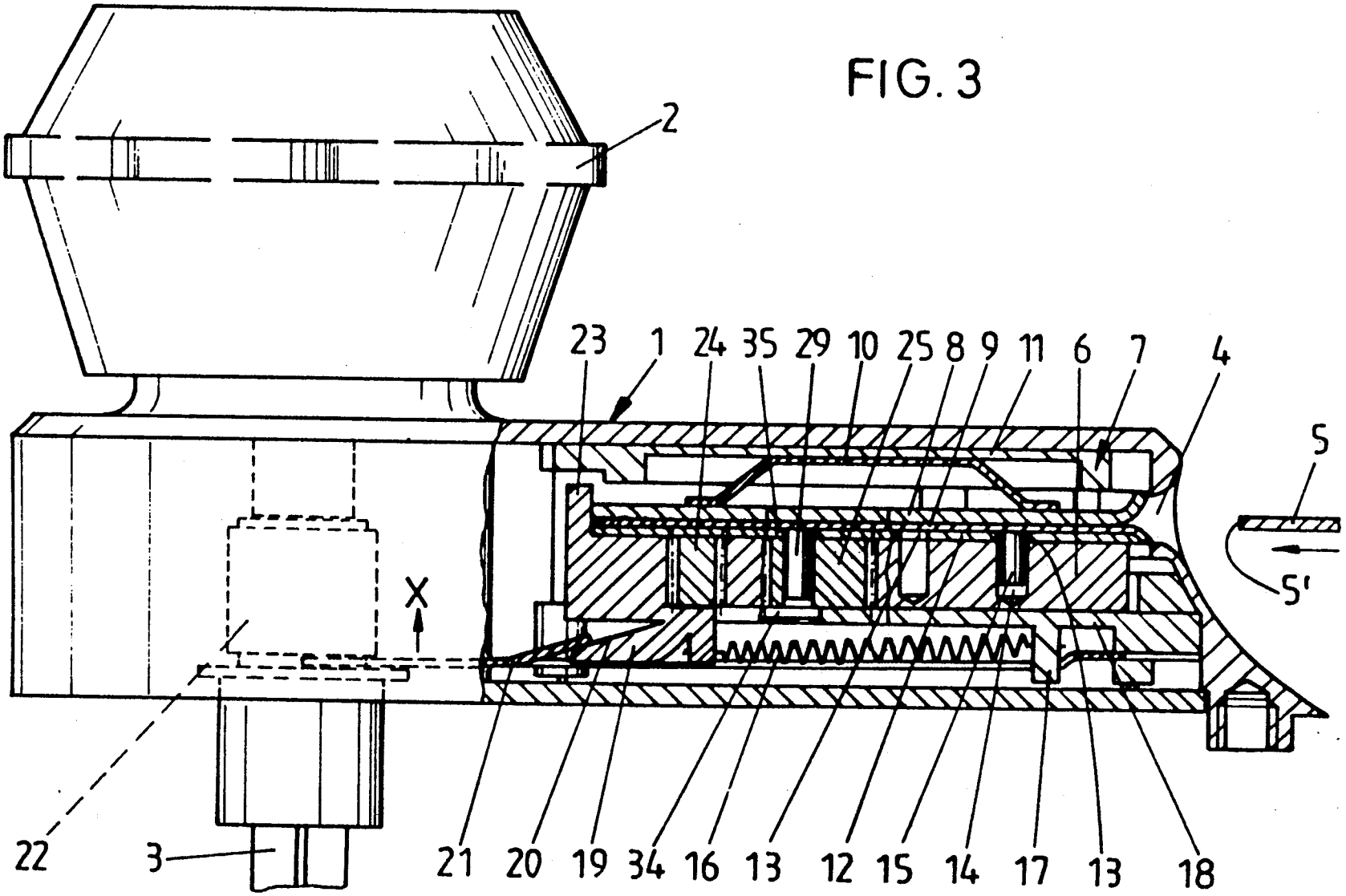
FIG. 3 shows the lock of the first embodiment in a larger view, partially in longitudinal section and partially in elevation, before insertion of the key.

In all the embodiments shown, the lock shown in FIGS. 1 and 2 has an elongated lock housing 1 associated with a locker door (not shown). At its one end, the housing has a turnable knob 2 by means of which a latch or bolt can be pulled back if the lock is in locking position.

The knob 2 can be coupled with a push pin 3 of square cross section by which a latch or bolt (not shown) can be pulled back.

In order to be able to actuate the lock from the outside of the door, the lock housing is provided on the edge side opposite the turn knob 2 with an insertion slot 4 into which a card-shaped key 5 can be inserted. The key 5 is a magnetically coded card which is of sufficient stiffness in order to be able to displace a pusher 6 which is guided within the lock housing 1.

The pusher 6 is received by an inner housing 7 which is placed in the lock housing 1 and bears two guide plates 8 and 9 which are arranged parallel to the pusher 6. The guide plate 8 is a plate consisting of ferromagnetic iron while the other guide plate is anti-magnetic. The guide plate 8 is thicker than the guide plate 9 which is adjacent to it and it is acted on by a leaf spring 10 which, on its part, rests against the bottom 11 of the inner housing 7. Before the insertion of the key 5, the guide plates 8, 9 lie flat against each other. If the key 5 enters between the guide plates 8 and 9, the guide plate 8 moves away, under spring action, in the direction towards the bottom 11.

The antimagnetic guide plate 9, on its part, rests against a blocking plate 12 consisting of non-magnetizable material. In the embodiment shown, brass is used for the blocking plate. In the blocking plate 12 there are, suitably distributed, circular blocking openings 13 which, in the initial position of the pusher 6, correspond to blind holes 14 in the latter. In some of the blind holes, pin-shaped permanent magnets 15 are introduced which, in their turn, are attracted by the guide plate 8 and pass through the blocking openings 13. Depending on their arrangement, the permanent magnets, in this case, act with their south pole or north pole on the guide plate 9. Accordingly, the pusher 6 cannot be displaced. Furthermore, action of a tension spring 16 urges the pusher in the direction towards the insertion slot 4. The tension spring 16 is connected at one end to a pin 17 of a cover 18 covering the pusher 6 and on the other end to a control projection 19 extending from the pusher 6. The projection is provided with an oblique surface 20 by means of which, upon forward displacement of the pusher 6, a leaf spring 21 which is fastened to the inner housing 7 at the height of the insertion slot 4 can be shifted in the direction indicated by the arrow X, it carrying along with it a coupling sleeve 22 and thereby bringing the turn knob 2 into a coupling position with the push pin 3, which then permits the door to be opened.

The forward displacement of the pusher 6, however, is possible only after insertion of the proper key 5 which, in the completely inserted position, rests with its edge side 5' against a drive shoulder 23 of the pusher, said shoulder lying towards the inside of the lock. In the key-inserted position, the corresponding permanent magnets 15 are then aligned with correspondingly positioned magnetization regions of the key. In this way, the permanent magnets are repelled in the direction towards the blind holes 14 and accordingly leave the blocking openings 13 of the blocking plate 12.

In order to change the magnetic closing code, the pusher 6 in accordance with the first embodiment has four turnable carriers 24, 25, 26, 27 which are coupled with each other and each of which is provided with a recoding magnet 28, 29, 30, 31. On the outside, the carriers 24 to 27 are provided with a toothing by which they are in toothed engagement with each other. In order to receive the carriers, holes 32 of suitable diameter are provided in the pusher 6. The carriers, each of which is provided with a recoding magnet, are so arranged with respect to each other that the recoding magnets, due to the turning motion of the carriers, move one after the other in each case into the position in front of an obstacle or out of said position. The obstacle 33 is formed by a transverse edge of a longitudinal groove 34 which extends in the direction of displacement y of the pusher 6. Since four recoding magnets are present, four such longitudinal grooves 34 are also provided. They are located in the cover 18 of the inner housing 7 which covers the pusher 6. The two longitudinal grooves 34 which are arranged further inward in the lock have a greater distance from each other than the other two longitudinal grooves 34.

Figure 4:
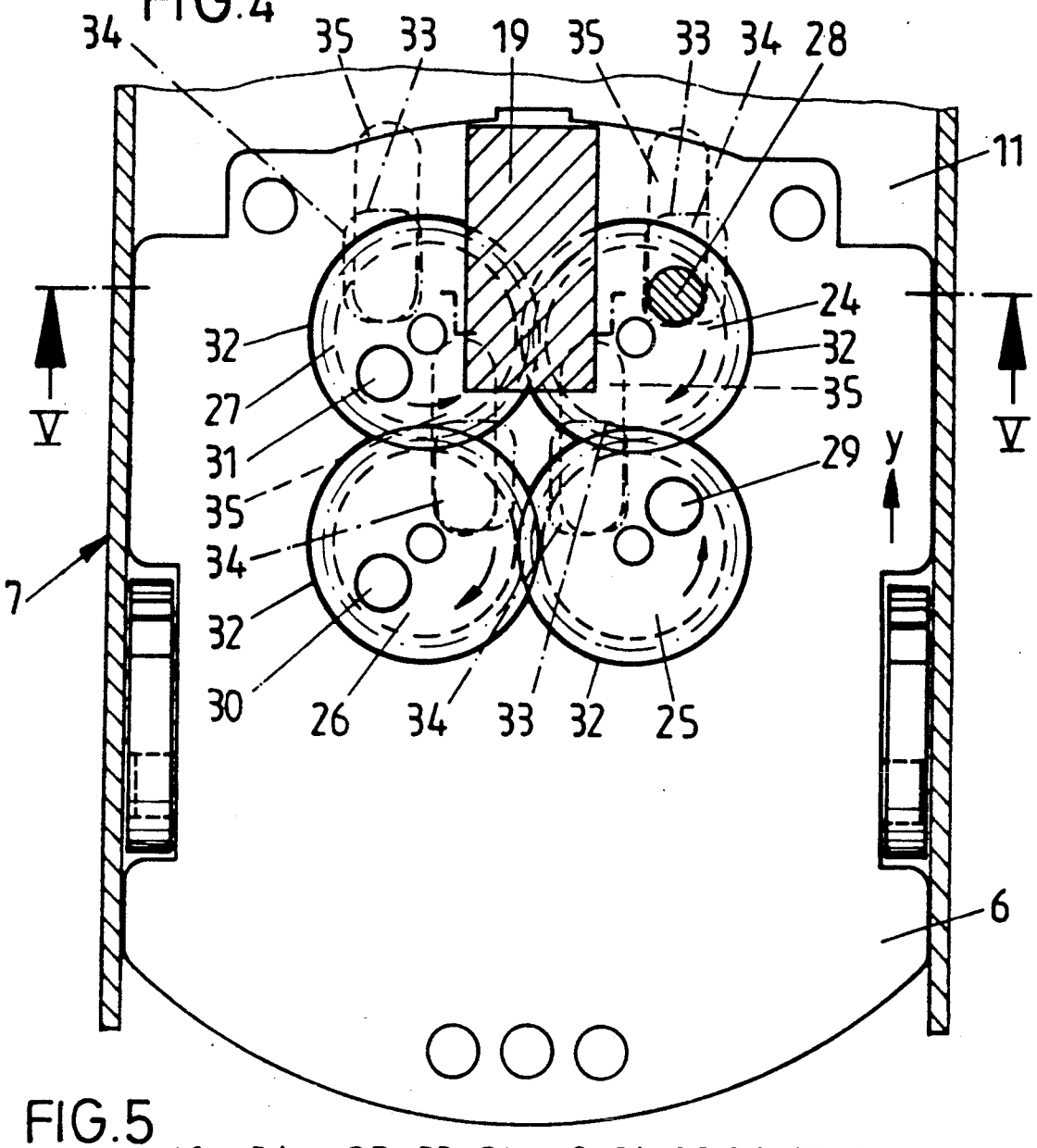
FIG. 4 is a section at the level of the one wide side of the pusher, showing the carriers which are in toothed engagement with each other.
Figure 5:
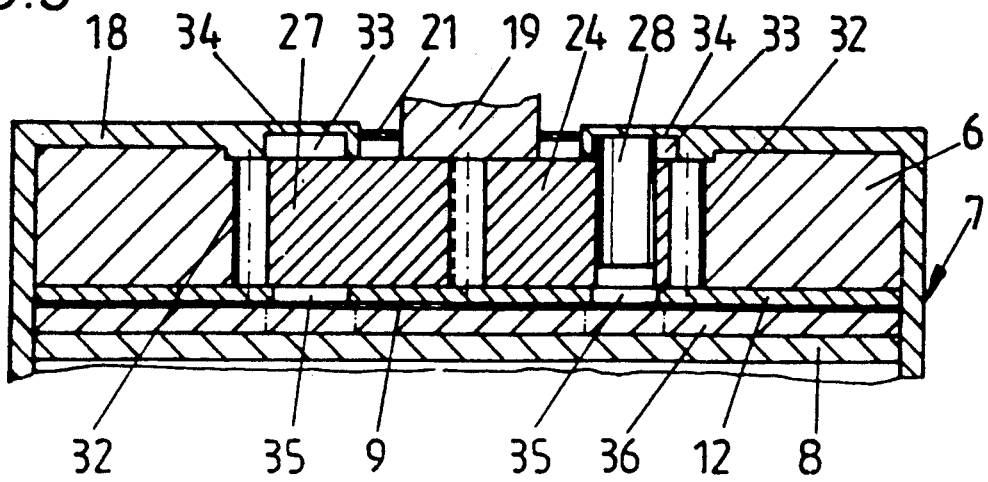
FIG. 5 is a section along the line V—V of FIG. 4.

However, of the four recoding magnets 28 to 31, only one in each case acts as true recoding magnet. In accordance with FIGS. 4 and 5, this is the recoding magnet 28. With its end which faces the blocking plate 12, it extends, when the command key 36 is not inserted into a longitudinal lot 35 lying in direction of displacement in the blocking plate 12. The other recoding magnets 29, 30, 31 can then extend into corresponding blocking openings 13 of the blocking plate 12 so that they assume in this case a function similar to the permanent magnets.

If the lock is associated, for instance, with a bathhouse locker door, the bathhouse guest has a guest key which is comparable to the key 5. With it, all permanent magnets 15 and recoding magnets 29, 30, 31 are so displaced that they come out of engagement with the blocking openings 13. In this way, the pusher 6 can be displaced in the direction of the arrow y, producing a coupling with the turn knob 2. Only the recoding magnet 28 is not displaced in this case. Movement of the pusher is nevertheless possible due to the longitudinal slot 35 in the blocking plate 12.

Figure 6:
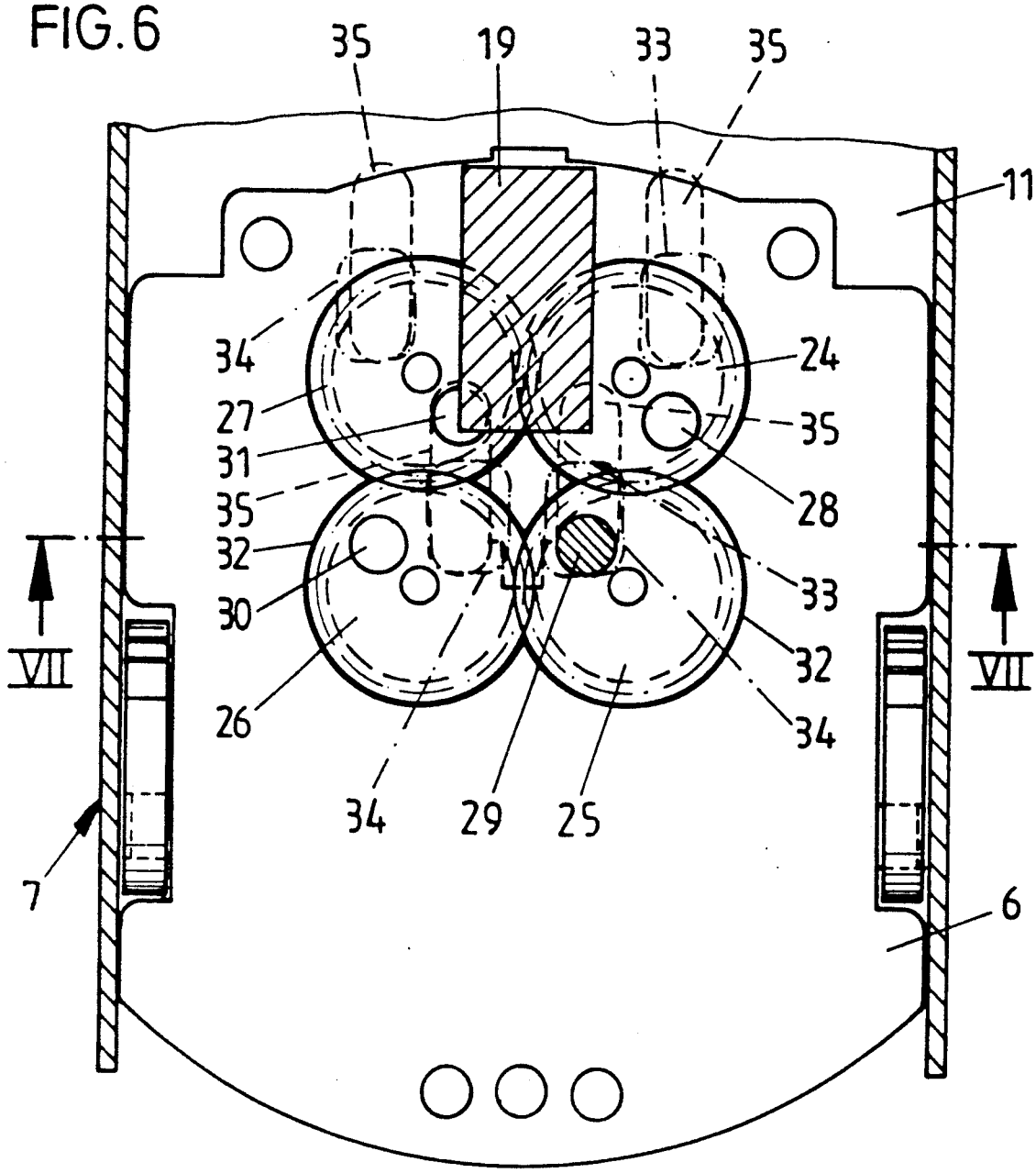
FIG. 6 is a showing corresponding to FIG. 4 but with the carriers turned forward one step after displacement of the pusher by means of a command key.
Figure 7:
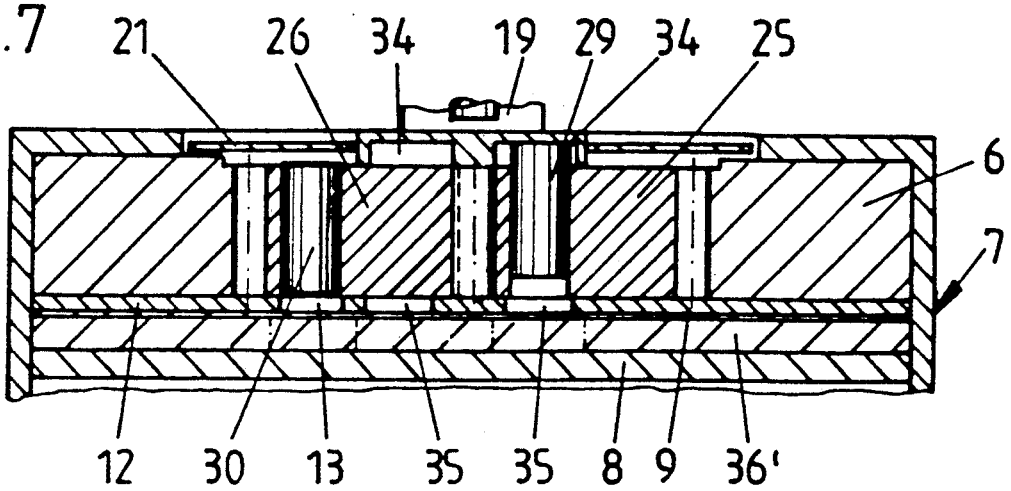
FIG. 7 is a section along the line VII—VII in FIG. 6.
Figure 8:
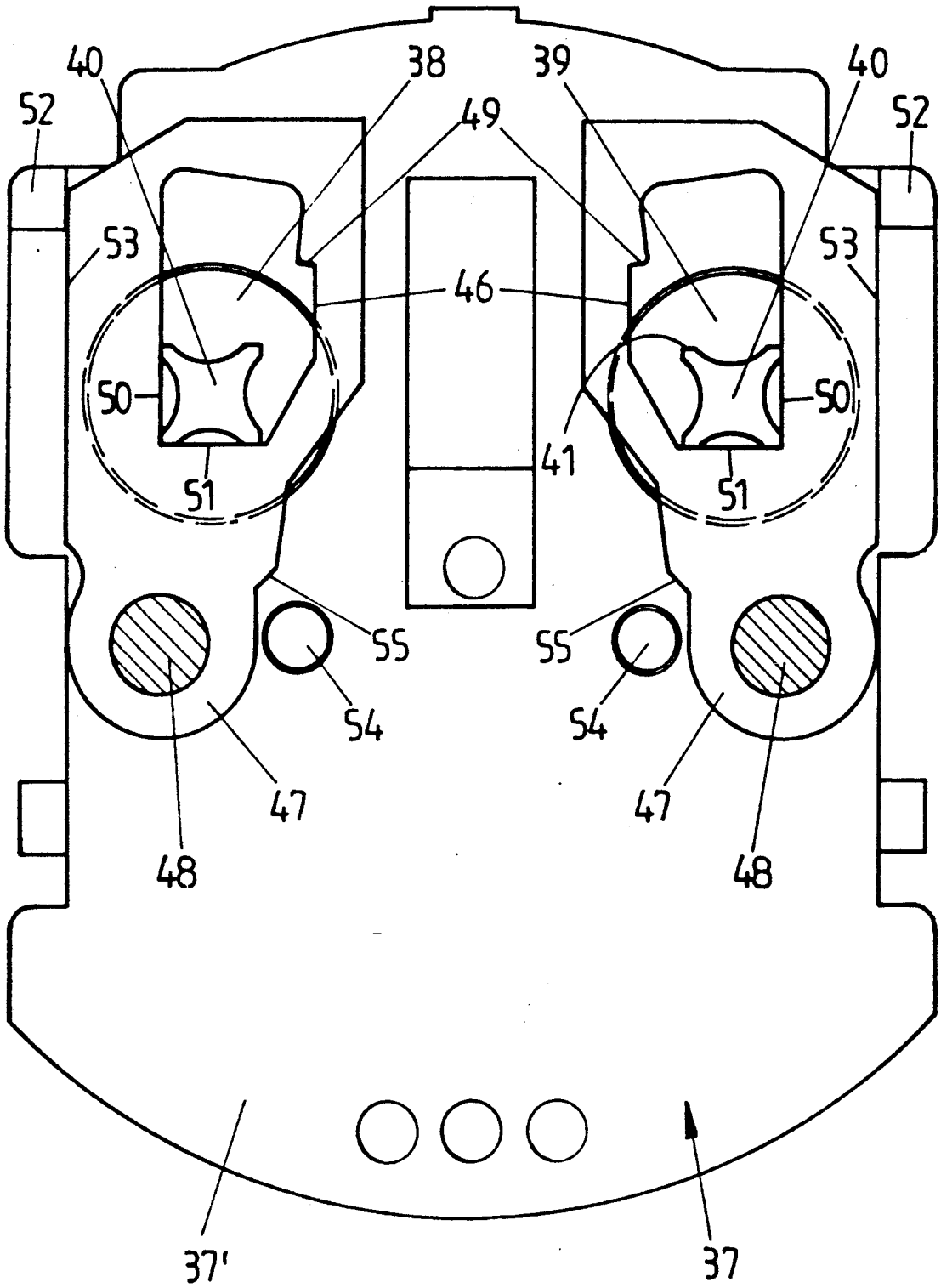
FIG. 8 is a top view of the pusher of the second embodiment, shown on a larger scale.
Figure 9:
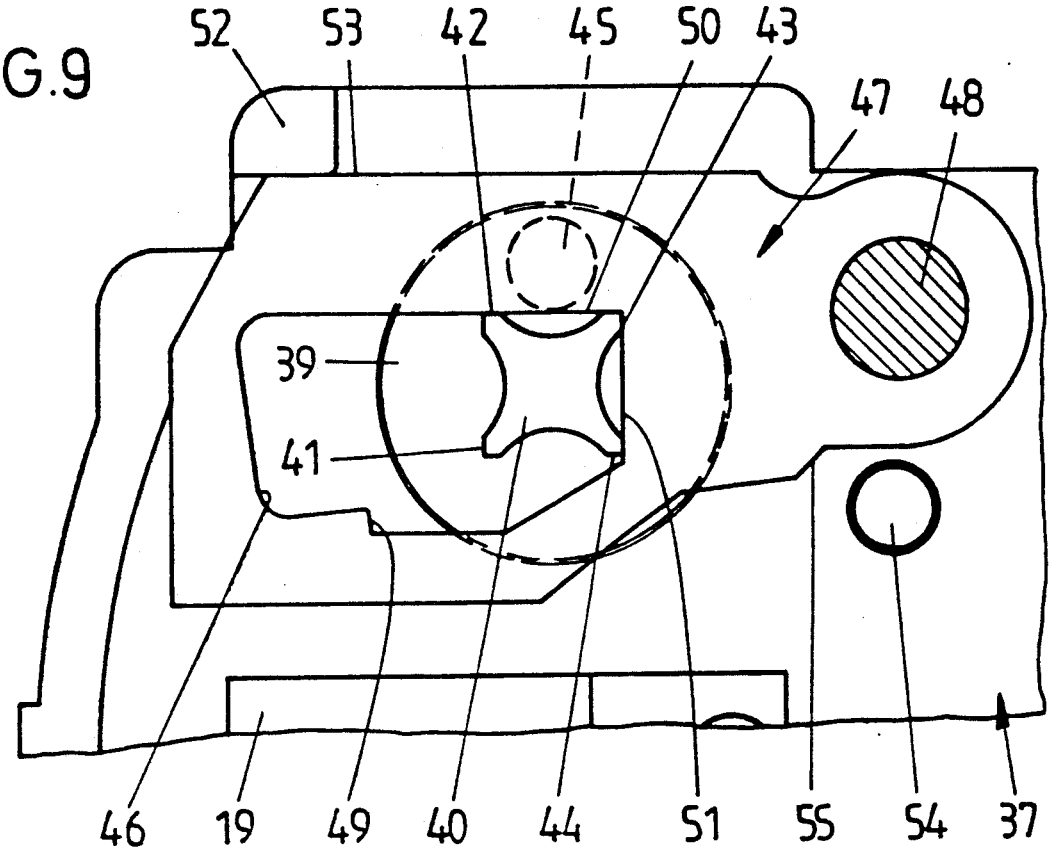
FIG. 9 is a greatly enlarged detail view of a portion of the pusher in the region of the carrier and of the control member associated with it which is arranged on the housing side.
Figure 10:
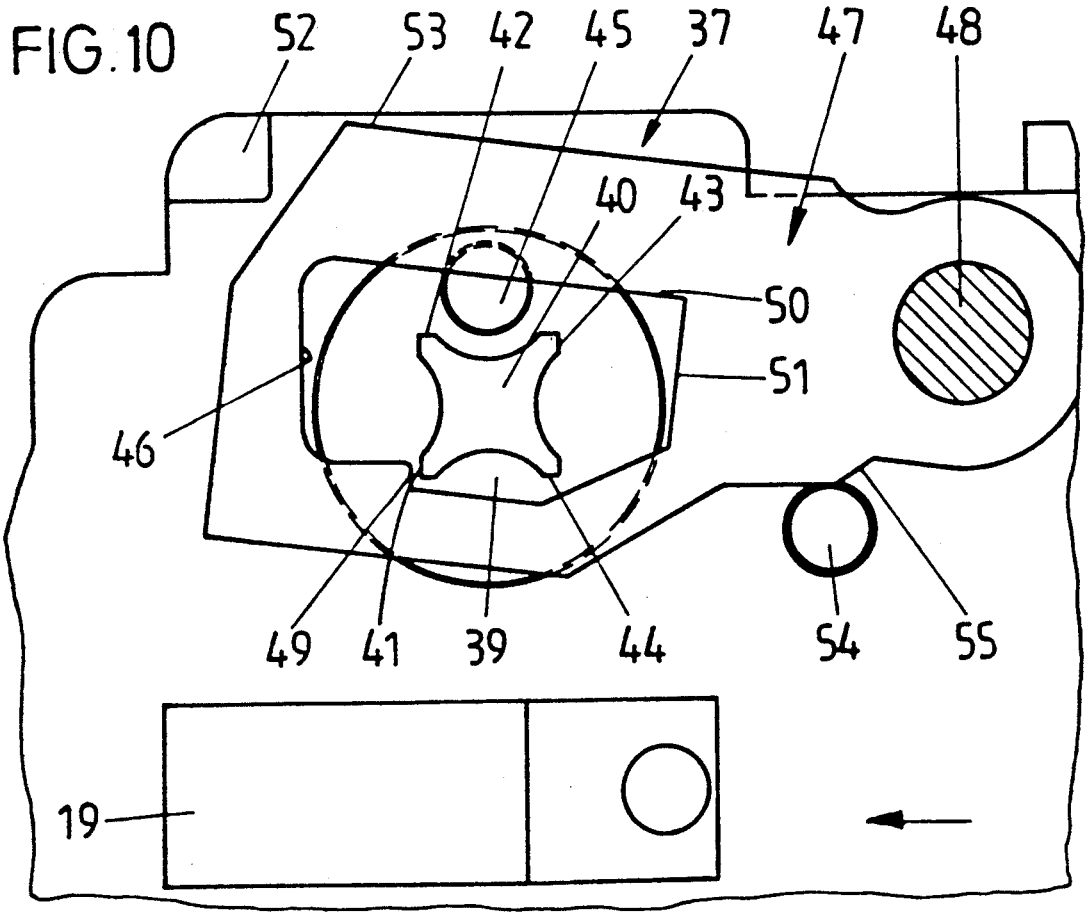
FIG. 10 shows an intermediate position upon the forward displacement of the pusher, with control member swung by the control magnet.

If the key of this bathhouse guest is not received back at the return device 1700 within the stipulated period of time (for instance by the evening) then the command is given to the delivery device to issue a command key by which the bathhouse supervisor can effect a recoding. By means of this command key all permanent magnets as well as the recoding magnet 28 are brought out of engagement with the locking plate 12. The recoding magnet 28 therefore enters into the longitudinal groove 34. Upon the subsequent displacement in the direction indicated by the arrow y by means of the command key 36, the corresponding end of the recoding pin 28 comes against the obstacle 33 in the longitudinal groove 34 and thereby brings about the turning of the carrier 24 and of the other carriers meshing with it in the direction shown by the arrow. After a displacement of the pusher 6, the position shown in FIGS. 6 and 7 is reached. The previous recoding magnet 28 has left its position of alignment with the longitudinal groove 34, while the recoding magnet 29 of the carrier 25 has come into the recoding position. It is therefore no longer possible to effect a displacement of the pusher by means of the previous guest key because of the recoding magnets which are then shifted. Furthermore, the guest must be issued a new guest key by means of which he can suitably displace all magnets except for the recoding magnet 29. By means of a command key 36', which the bathhouse supervisor has, this recoding can also be changed again, a different recoding pin then entering into the corresponding recoding position.

Variations with respect to this embodiment are possible in the manner that the number of carriers is changed. It is also possible to provide each carrier with more than one recoding magnet.

In accordance with the second embodiment, shown in FIGS. 8 to 12, the pusher is designated by the numeral 37. Its construction corresponds to the pusher 6. One change is that the pusher now receives two carriers 38 and 39 which lie alongside each other at the same height. On its end facing away from the insertion slot, each carrier 38, 39 is continued in a switch cam 40 which extends above the corresponding wide surface 37' of the pusher and which forms switch cam edges 41, 42, 43, 44 which, in their turn, are arranged in the manner of a Maltese cross. Each carrier 38, 39 also receives a recoding magnet 45, for its part, cooperates with corresponding blocking openings in the blocking plate 12.

The Maltese-cross-like switch cam 40 passes through an inner opening 46 in a control member 47 which is fixed in position. The mounting pin 48 thereof is seated in suitable manner on the cover 18 of the inner housing 7. The mounting place of the single-arm control member 47 faces, in this connection, the direction of insertion of the key. By an edge which lies approximately perpendicular to the direction of displacement of the pusher 37, the inner opening forms an obstacle 49. The inner opening 46 is so developed that, in the starting position of the pusher, three corners of the Maltese cross form stop surfaces for two inner-opening walls 50, 51 which are at right angles to each other. Furthermore, there is also provided on the pusher 37 a stop 52 against which the rear edge 53 of the control member 47 comes. In this way, the latter is secured against turning. Upon displacement of the pusher, this securing is only eliminated when the control magnet 54 has passed, for instance, through the idle stroke. The stop 52 together with the edge 53 also effects the last part of the remaining rotation of the Maltese cross into the basic position shown in FIG. 8 upon the return displacement of the pusher.

At the height of the mounting place of the control member 47, a suitably polarized control magnet 54 is guided in the pusher 37. Upon the use of a normal key, this control magnet 54 is not displaced. This means that the end of the control magnet 54 which faces the blocking plate extends in a longitudinal slot in the blocking plate 12.

Figure 11:
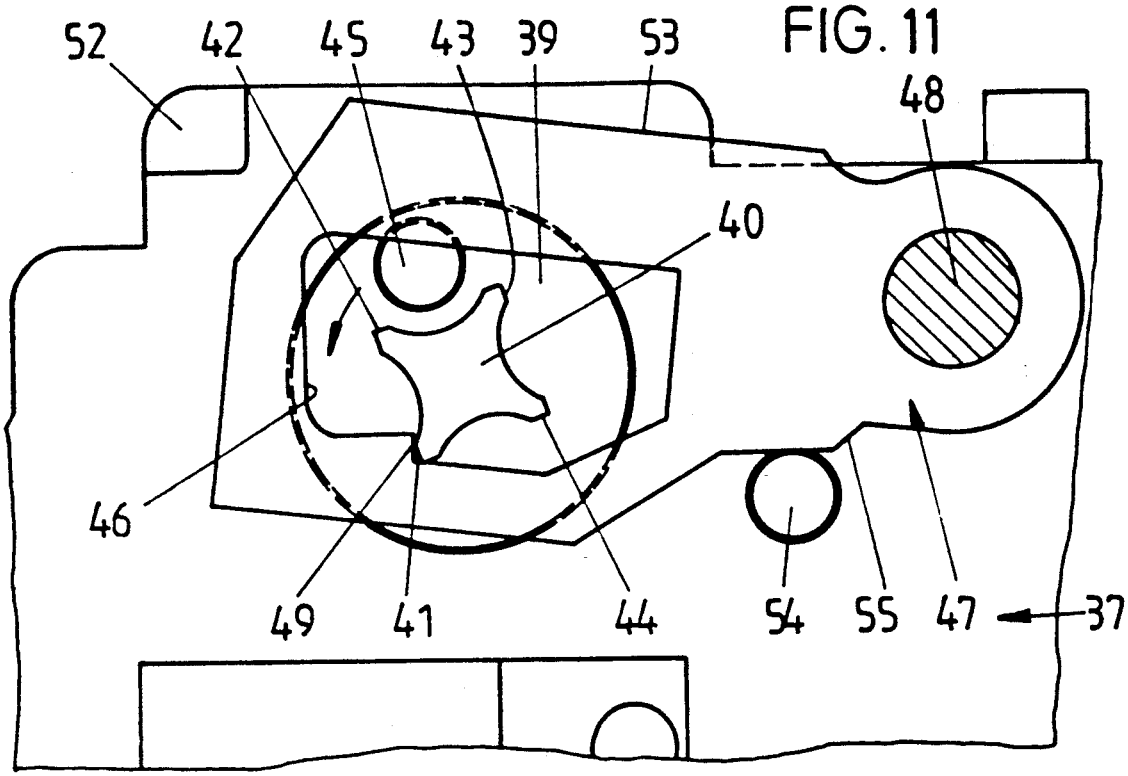
FIG. 11 shows the following intermediate position, indicating the forced turning movement of the carrier.
Figure 12:
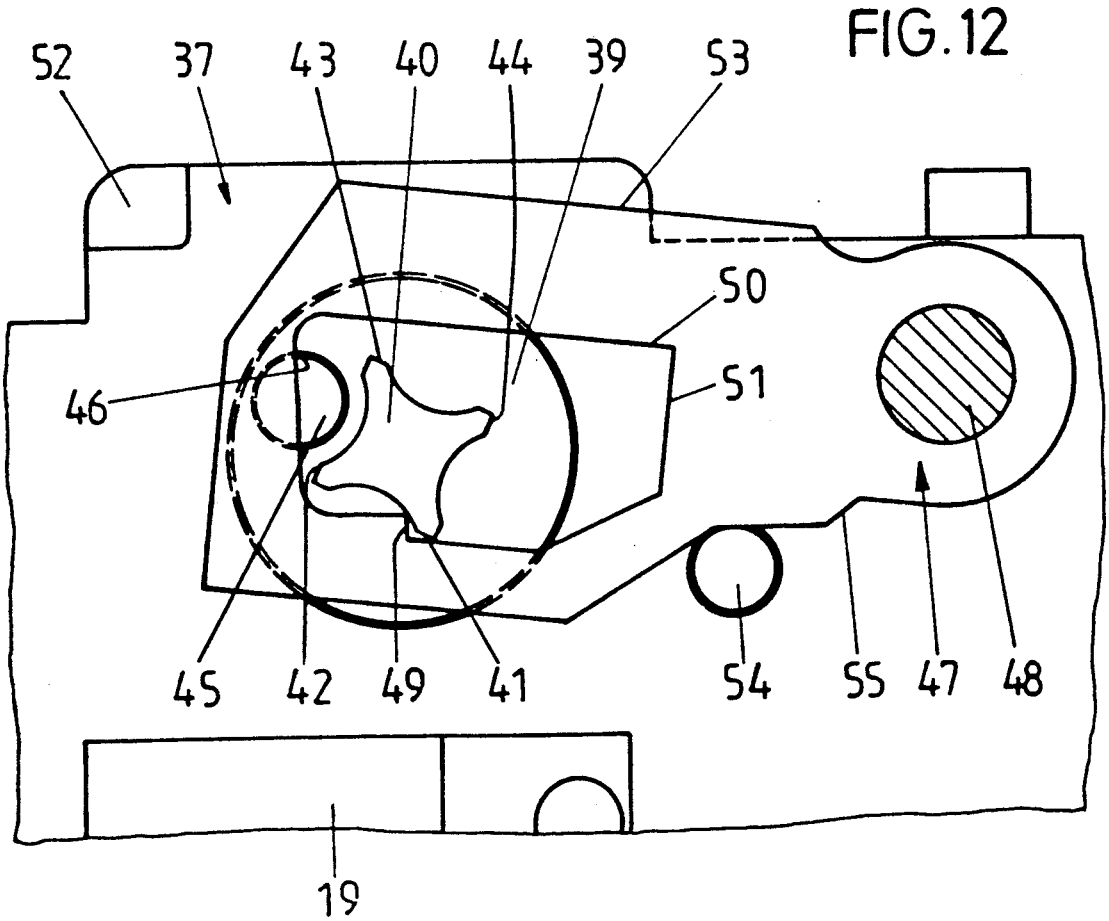
FIG. 12 shows the pusher in the completely advanced position.

If a recoding of the lock is to take place, a command key is to be used as in the case of the preceding embodiment. By it, the permanent magnets, the recoding magnet 45 and the control magnet 54 are brought out of engagement with the blocking plate. After passing through a small idle stroke, the end of the control magnet 54 which extends beyond the wide surface 37' of the pusher strikes a control flank 55 of the control member 47 and lifts the latter into the position shown in FIG. 10. In this way, the result is obtained that the obstacle 49 then lies at the height of the switch-cam edge 41. Upon further displacement of the pusher 37 the position shown in FIG. 11 is reached. From that figure it can be noted that the carrier 39 is turned by the obstacle 49 in the direction indicated by the arrow. After complete forward displacement of the pusher 37, the position shown in FIG. 12 is present. In this position, the carrier 39 and the recoding magnet 45 accordingly assume a different position of angular rotation. If the pusher 37 is now brought again into its starting position, the aforementioned remaining rotation of the carrier 39 takes place, so that the recoding magnet 45 is then aligned with another blocking opening in the blocking plate. The guest key which was previously used then no longer arranges this relocated recoding magnet and the pusher 37, accordingly, cannot be displaced forward in order to open the lock. A correspondingly coded key is to be issued to the following guest.

Figure 13:
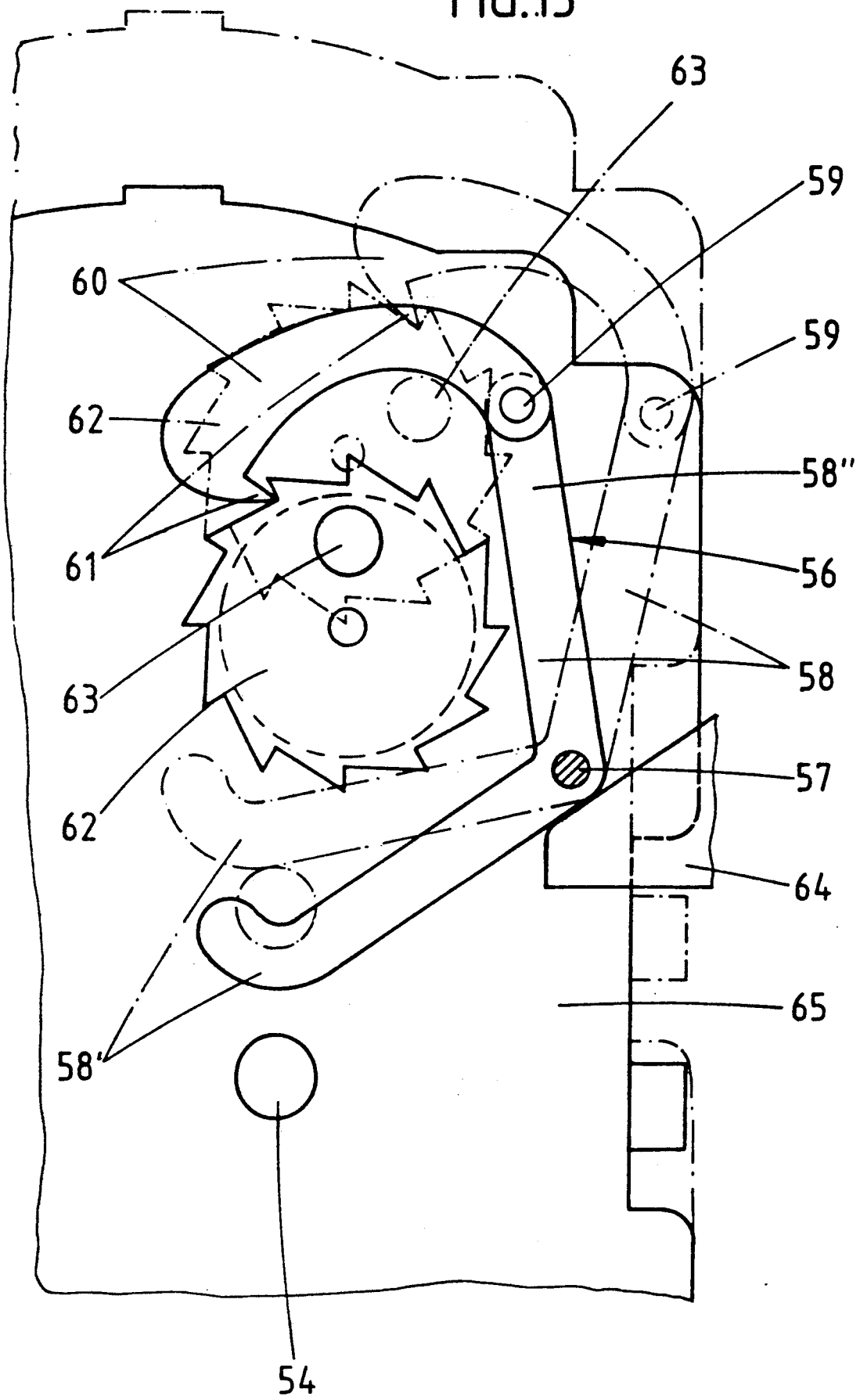
FIG. 13 is a partial top view of the pusher with carrier and the multi-member pawl turning it, referring to the third embodiment.

In the case of the modified third embodiment shown in FIG. 13, the control member 56 is developed in the manner of a multi-member pawl. It has an angle lever 58 which is mounted on the housing side by the pin 57. Its one lever arm 58' lies in the region of movement of a control magnet 54. Here also there is a short idle stroke between the control magnet 54 and the lever arm 58'. The other lever arm 58'' bears, by means of a pivot pin 59, a pawl lever 60 the blocking tooth 61 of which, forming an obstacle, cooperates with the teeth of the carrier 62 developed as a ratchet wheel. This carrier receives a recoding magnet 63. A spring (not shown) urges the angle lever 58 in counterclockwise direction. Its initial position is limited by a stop 64 on the housing side. The pawl lever 60 is also associated with a spring (not shown) which is seated, for instance, on the pivot pin 59 and urges the pawl lever 60 into toothed engagement with the carrier 62.

If the normal key is used, the permanent magnets of the pusher 65 and the recoding magnet 63 are brought out of engagement with the blocking plate 12. The control magnet 54 passes, in this connection, through a longitudinal slot in the blocking plate 12 and accordingly does not exert a blocking function.

The recoding is effected in this third embodiment also by means of a corresponding command key which displaces, in addition to the other magnet pins, also the control magnet 54 and lifts it out of the blocking plate. The end thereof which protrudes beyond the wide surface of the pusher 65 thus lies at the height of the lever arm 58' of the control member 56. During the forward movement of the pusher 65, the control magnet 54, after an idle stroke, acts on the lever arm 58 and swings the angle lever 56, the carrier 62, which is mounted in the pusher 65, being turned further as a result of further forward displacement of the pusher 65 and via the pawl lever 60. The recoding magnet 63 is thereby imparted a different position with respect to the pusher 65. In this position, it is aligned, when the pusher 65 has been displaced backwards, with a blocking opening of the blocking plate 12, so that the previously used key no longer locks. A new key must then be turned over to the next guest. In this embodiment, two similarly shaped carriers 62 with blocking member 56 can also be associated with the pusher 65. A modification of this embodiment could be effectied in the manner that instead of the pawl lever 60 an escapement is provided, as in the case of a clockwork. A clock spring which can be wound up is then associated as force storage means with the carrier or its shaft. The lever arm 58 is not necessary in this embodiment. Via the control magnet 54, the escapement, upon the forward displacement of the pusher, receives the command to permit the carrier to turn further by one step, the force for which then results from the clock spring.

Figure 14:
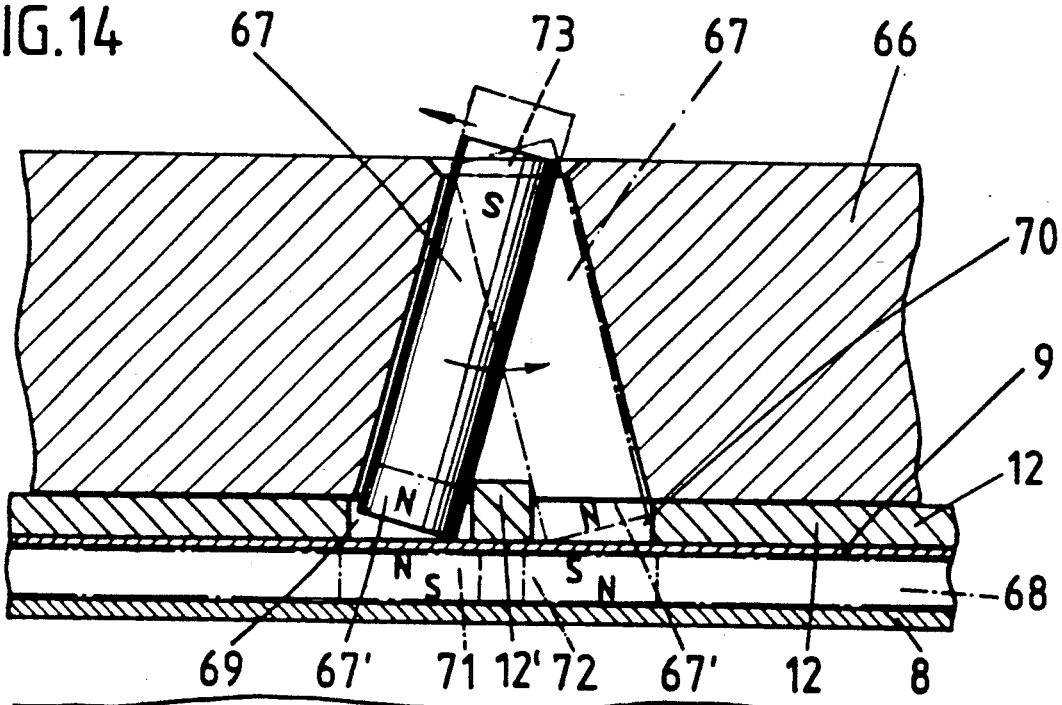
FIG. 14 is a cross section through the pusher at the height of a permanent magnet which is arranged in the manner of a pendulum, referring to the fourth embodiment.
Figure 15:
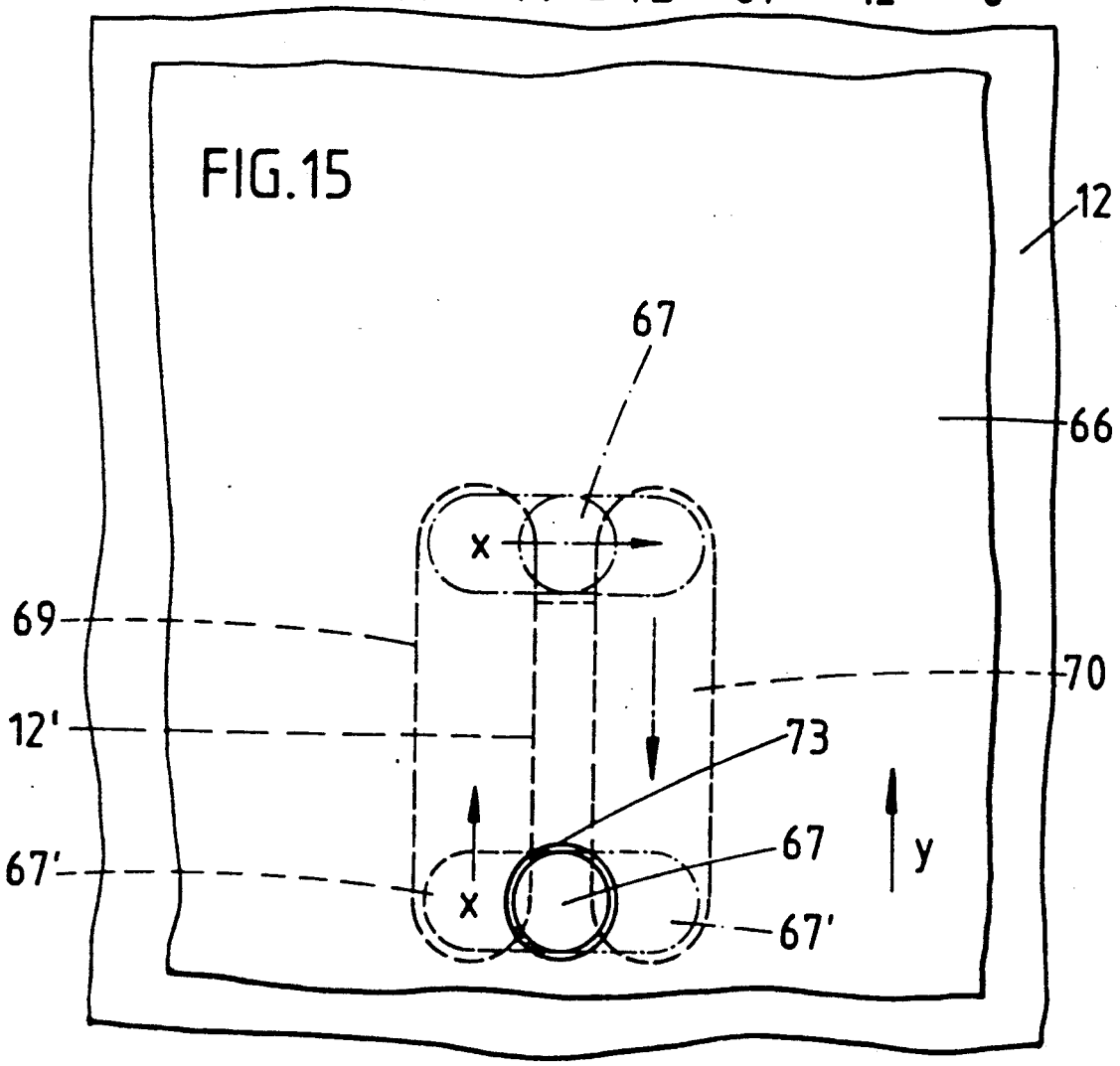
FIG. 15 is a top view of FIG. 14.

In accordance with the fourth embodiment, shown in FIGS. 14 and 15, the pusher is provided with the reference numeral 66. At least one of the permanent magnets 67 borne by it is guided, by the end thereof facing the blocking plate 12, in a blocking-plate longitudinal-slot opening 69. Parallel to this there extends another blocking-plate longitudinal-slot opening 70. As to the permanent magnet 67, it may be a control magnet for a previously described control member. Then no special command key is required in order to effect the resetting. The following guest receives a key 68, shown in dash-dot line in FIG. 14, which has two adjacent magnetic zones 71, 72 for the permanent magnet 67. The zone 71 is so polarized that it acts in repulsion after the pushing-in of the successor key 68. By the displacement then of the key with the pusher 66, the control member lying in the path of the control magnet 67 is acted upon. After complete forward advance of the pusher, the position shown in dash-dot line in FIG. 15 is reached. In this position there takes place a pendulum displacement of the permanent magnet 67 into the other pendulum position, caused by the magnetic zone 72 of opposite polarity. In this way, the permanent magnet or control magnet 67 is pushed into the position shown in dash-dot line in FIG. 14. In order that the permanent magnet 67 does not swing prematurely, the blocking plate 12 is provided between the longitudinal slot openings with a thickening, designated 12', in front of which the lower end of the permanent magnet comes upon an attempted displacement. By the zone 72 the shifted end 67' is pulled into the adjacent locking-plate longitudinal-slot opening 70 and remains there even upon the further closing actuation by this key 68. The key previously used, on the other hand, cannot effect a displacement of the pusher 66. A further resetting can only be caused by a key which is issued again and which forms correspondingly magnetized regions.

In order to be able to permit the pendulum-like movement of the permanent magnet 67, the end of the receiving opening 73 facing away from the key is circular and the opposite end is oval. The lengthwise direction of this oval is transverse to the direction of displacement y of the pusher 66.

A modification is possible to the effect that, instead of the control-plate longitudinal-slot opening 69, a circular blocking-plate blocking opening is used. The permanent magnet 67 then acts like the other permanent magnets. After the return of the pusher into its initial position, it always returns into the blocking-plate blocking opening. For the recoding, a key is then used which corresponds to the key 68. This means that the pendulum movement takes place in the forward displaced position of the pusher, where-upon the key magnetization or the magnetic zone 72 pulls the shifted end 67' into the blocking-plate longitudinal-slot opening 70. Such an embodiment is then independent of a control function for a carrier.

Figure 16:
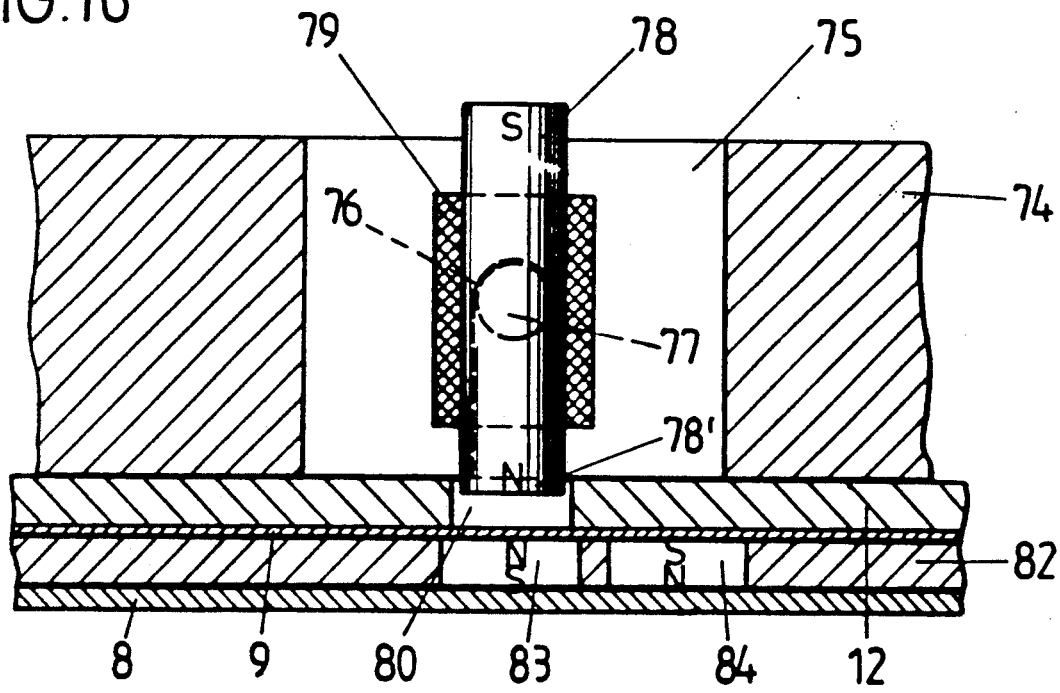
FIG. 16 is a cross section through the pusher at the height of a permanent magnet which can be displaced by 180 degrees around a transverse axis.
Figure 17:
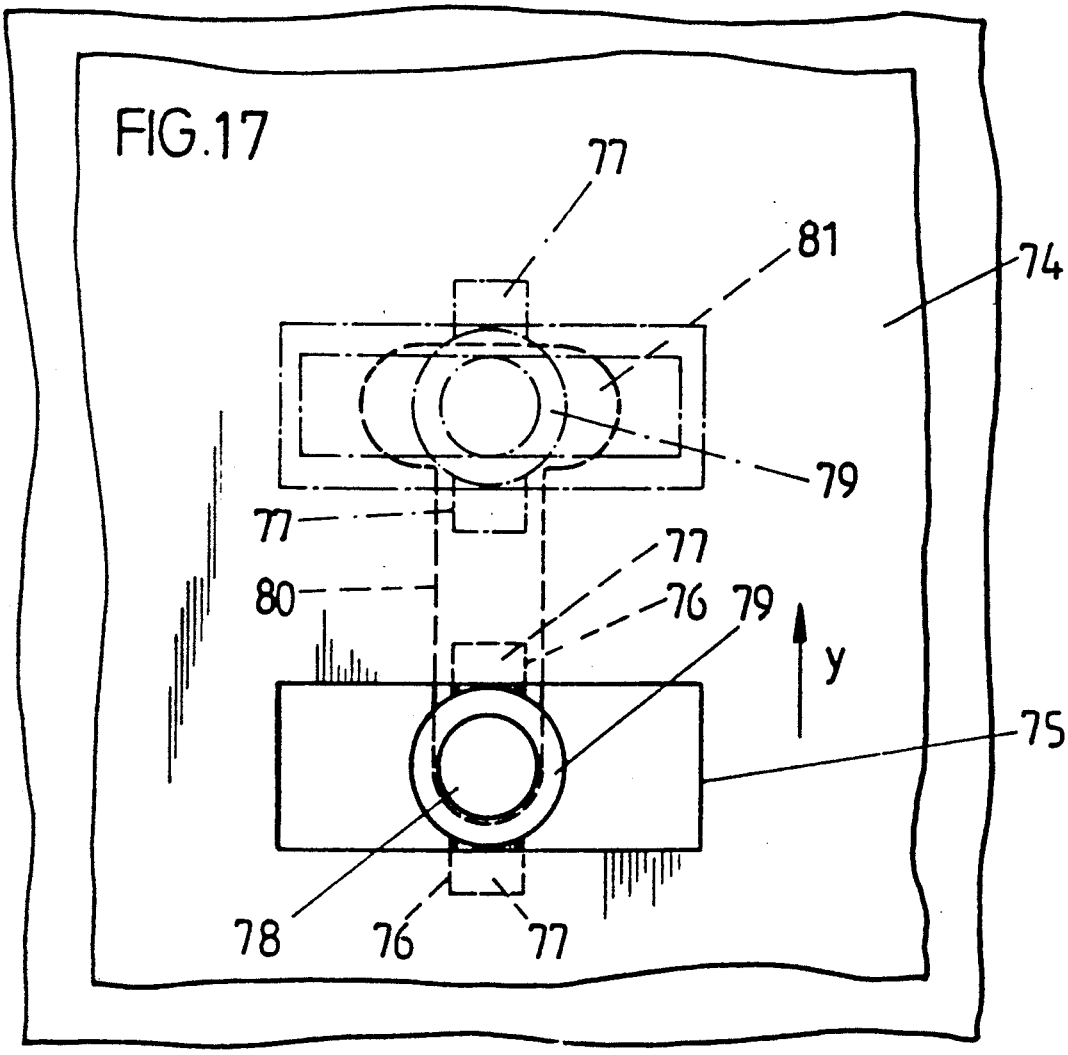
FIG. 17 is a top view of FIG. 16.
Figure 18:
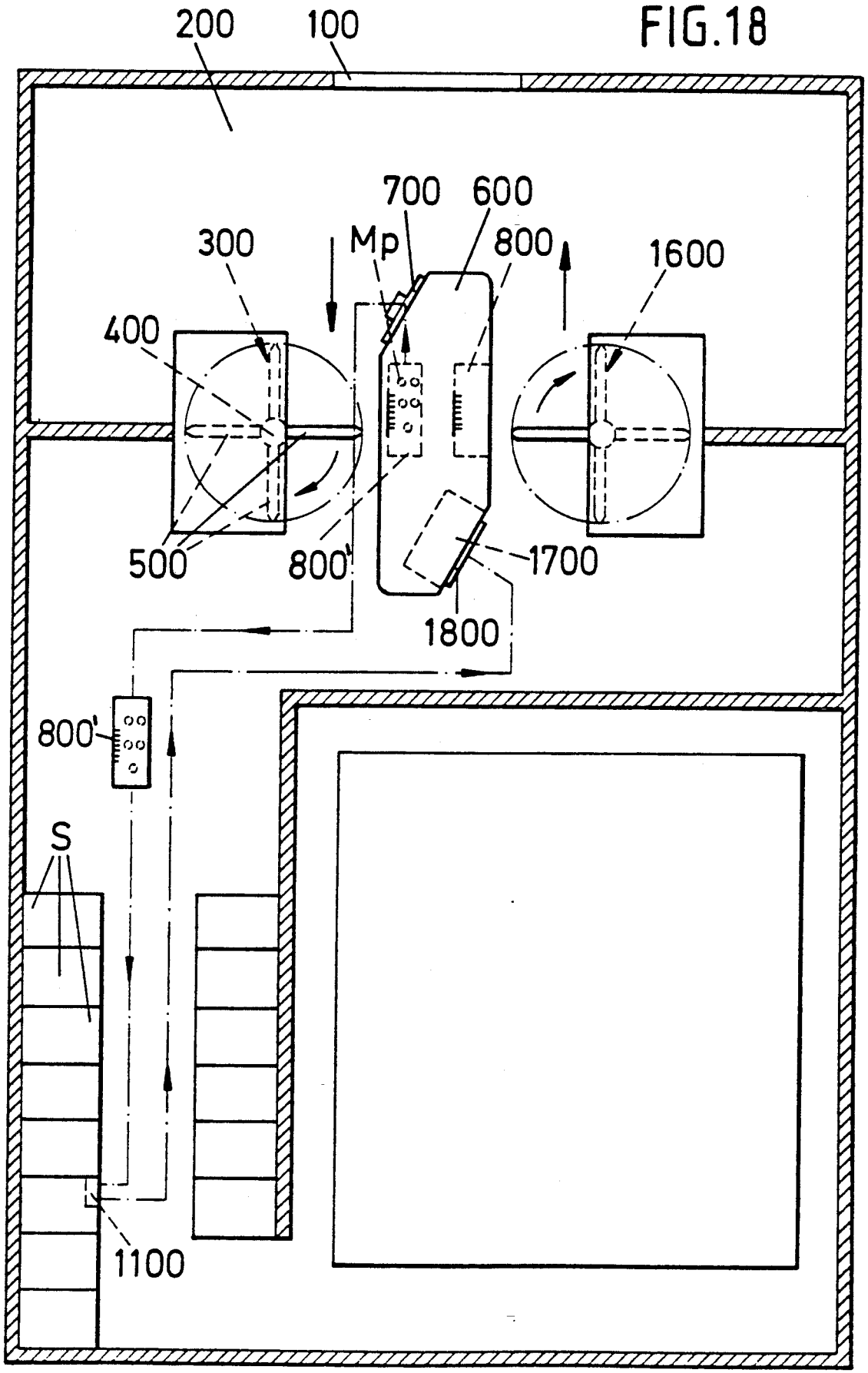
FIG. 18 is an overall view of a bathhouse situation employing the invention.

The fifth embodiment can be noted from FIGS. 16 and 17. The pusher 74 is provided with an elongated recess 75 which extends transverse to its direction of displacement. From the side of the pusher facing the blocking plate 12 there extend centrally two mounting recesses 76 which are opposite each other and into which mounting pins 77 extend. These pins are part of a plastic cylindrical sleeve 79 which surrounds a permanent magnet 78. When the key is not introduced, the polarized end 78 of the permanent magnet 78 which faces the blocking plate 12 is pulled into blocking-plate longitudinal-slot opening 80, which lies in the direction of displacement of the pusher 74, up to the guide plate 9. This blocking-plate longitudinal-slot opening 80 widens in T-shape at the end opposite the insertion slot 4, forming a transverse slot 81. If a key 82 is now inserted which has two adjacent zones 83, 84 which are of opposite magnetic polarity, permanent magnet 78 is acted on in repulsion by the zone 83. It thus passes into the position shown in FIG. 16 in which the end 78' facing the key still remains within the longitudinal slot. Operation with the key is obtained by the mounting recesses 76 which limit the movement of the permanent magnet 78. During the forward displacement, the end of the magnet pin which extends beyond the corresponding wide surface of the pusher can serve to control a control member which effects a recoding of a carrier-side coding pin. The permanent magnet 78 thus serves as control magnet. As soon as the permanent magnet or control magnet 78 reaches the transverse slot 81, it swings 180 since it is exposed to the force of attraction of the magnetic zone 84 and is pulled into the longitudinal slot 80. Further use of the key 82 then does not lead to any controlling of the permanent magnet 78 and thus to any recoding. This must then again be effected by means of a key in which the magnetic regions are suitably polarized. If the permanent magnet 78 is not used as control magnet and only one blocking-plate blocking-opening is provided for it, an alternative possibility of closing can be obtained by means of corresponding keys. This means that after locking by means of one key, locking is possible only by means of another key. Repeated successive locking by means of one key can then no longer be effected.

Another embodiment can be obtained by providing the key with an additional coding. Upon the insertion of the key, the evaluation of this additional coding takes place. If the key has the correct coding, then an obstacle by which a recoding is effected is brought into the position of action, whether it be a displacement of a permanent magnet or a displacement of a recoding magnet held by a carrier. The blocking-plate openings and blocking-plate longitudinal slots can also be provided in an additional plate. A force accumulator can be so coupled with the pusher that it is wound up a certain amount by each displacement of the pusher. Since, as a result of the more frequent normal key actuation, the pusher is actuated more frequently without a resetting displacement, it results statistically that it is never completely discharged.

I claim:

1. A system for the use of locks in lockable facilities including locks of hotel room doors, and lockers of bathhouses, the system comprising a central delivery station located in a region of an entrance station of a lockable facility for the issuance of locking elements, each of which fits a given lock of respective doors, each lock having a magnet pin combination;

lockers, an exit station, and a locking-element return device which is located in a region of the exit station and for scanning a locking element and evaluating the locking element, the return device being connected for data to the delivery station; and wherein the delivery station comprises;

a store of locking-element cards, the cards having differing identifiers;

a magnetization device which polarizes a locking-element card in regions corresponding to a magnet-in combination of a locker lock;

a memory coupled to the magnetization device, the memory storing magnetization combinations corresponding to the respective identifiers; and an erasing device;

the return device comprises an identifier scanning device which activates the erasing device of the delivery station to erase from the memory a stored corresponding magnetization combination to free the magnetization combination for a new issue of card and assignment to a new identifier of the card;

a locker lock comprises a pusher and a set of permanent magnets movable within openings of the pusher from a blocking position, the pusher being movable into a lock-open position, a command key insertable into the locker lock for moving the pusher, and wherein the locker lock has a magnetic coding formed of individual ones of the permanent magnets which are arranged in openings of the pusher and liftable out of their blocking position by means of correspondingly positioned magnetization regions of a key brought into a position parallel to the pusher, whereupon the pusher is shiftable into a lock-open position, a part of the permanent magnets being developed as recoding magnets which are displaceable relative to a broad surface of the pusher from one position into another so as to change the magnetic coding, displacement of at least one of the recoding magnets taking place in synchronism with displacement of the pusher by means of the command key.

2. A system according to claim 1, wherein in the lock, the pusher comprises a plurality of interconnected carriers which are rotatable in the pusher, each carrier having at lest one of said magnets, which magnets pass, one after the other, as a result of turning movement of the carrier, into a position in front of said obstacle and out of said position, respectively.

3. A system according to claim 2, wherein the rotatable carriers are in toothed engagement with each other.

4. A system according to claim 1, wherein a lock comprises an obstacle facing the pusher; and upon the movement of displacement of the pusher, a recoding magnet which is lifted out comes against the obstacle, the obstacle lying in a displacement path.

5. A system according to claim 4, wherein a lock includes a cover having a longitudinal edge and being located alongside the pusher; and the obstacle is formed by a transverse edge of a longitudinal groove extending in displacement direction in the cover above the pusher.

6. A system according to claim 5, wherein a lock comprises a blocking plate located below the pusher; and within a lock, a recoding magnet extends, via an end thereof facing the key in non-lifted-out position, into a longitudinal slot, lying in the direction of displacement, in said blocking plate.

7. A system according to claim 5, wherein a lock comprises a plurality of switch-cam edges, and a control element mounted in fixed position to serve as an obstacle;

in a lock, the pusher comprises carriers of the magnets, at least one of the carriers is rotatable relative to the pusher and has at least one recoding magnet and comes, via one of said switch-cam edges, against the control element, and is displaced into the path of a switch cam edge of by means of one of the magnets upon a lifting of the magnet by means of the command key.

8. A system according to claim 7, wherein the switch cam edges are arranged in the manner of a Maltese cross.

9. A system according to claim 7, wherein the magnet strikes the control element, in a rest position of the pusher, and is secured against swinging only after a short idle stroke of the pusher.

10. A system according to claim 8, wherein the Maltese cross extends into an inner opening of the control element, said opening forming an obstacle on an edge.

11. A system according to claim 7, wherein the control element comprises a multimember pawl; and the carrier comprises a ratchet wheel.

12. A system according to claim 6, wherein the blocking plate has openings for holding said permanent magnets; and at least one of the permanent magnets, by means of its end which faces the key, after being lifted out of its blocking plate opening, is shiftable with its end facing the key into an adjacent longitudinal-slot opening of the blocking plate.

13. A system according to claim 12 wherein shifting of the magnet consists of a pendulum movement around the opposite end of the permanent magnet.

14. A system according to claim 12, wherein magnetization of the key pulls the shifted end into the longitudinal-slot opening of the blocking plate.

15. A system according to claim 12, wherein the shiftable permanent magnet is developed as control magnet for a control element, and that the shiftable end extends in two positions into longitudinal-slot openings of the blocking plate.

16. A system according to claim 6, wherein
at least one of the permanent magnets is rotatable by its end facing the key, after lifting out from its blocking opening within the pusher, around a transverse axis by 180° after displacement of the pusher, providing that the end of opposite polarity then faces the key.

17. A system according to claim 16, wherein the blocking plate opening continues in a blocking-plate longitudinal-slot opening lying in the direction of displacement of the pusher, to which opening a transverse slot extends in a T-shaped arrangement.

18. A system according to claim 16, wherein
the rotatable permanent magnet is developed as a control magnet for a control element.

19. A system according to claim 18, wherein
a lock further comprises a force accumulator, and a release device which operate to provide a stepwise turning of a carrier upon actuating by a control magnet.

20. A system according to claim 19, wherein
the force accumulator is charged by displacement of the pusher.

* * * * *